US006955662B2

(12) United States Patent
Moser et al.

(10) Patent No.: US 6,955,662 B2
(45) Date of Patent: Oct. 18, 2005

(54) DISPOSABLE PERINEUM CLEANING DEVICE

(76) Inventors: Scott Andrew Moser, 5726 La Jolla Blvd. Suite 104, La Jolla, CA (US) 92037; Szu Han Chiang, 5726 La Jolla Blvd. Suite 104, La Jolla, CA (US) 92037; Jessie Ho, 5726 La Jolla Blvd. Suite 104, La Jolla, CA (US) 92037; Justin Williams, 5726 La Jolla Blvd. Suite 104, La Jolla, CA (US) 92037

( * ) Notice: Subject to any disclaimer, the term of this patent is extended or adjusted under 35 U.S.C. 154(b) by 448 days.

(21) Appl. No.: 10/281,837

(22) Filed: Oct. 28, 2002

(65) Prior Publication Data

US 2004/0082924 A1 Apr. 29, 2004

(51) Int. Cl.[7] ..... A61M 31/00
(52) U.S. Cl. ..... 604/279
(58) Field of Search ..... 604/517, 39–42, 604/73, 174, 257, 260, 261, 279; 128/845; 222/845, 566, 568, 575, 92, 211, 233; 4/443, 448

(56) References Cited

U.S. PATENT DOCUMENTS

| | | | | |
|---|---|---|---|---|
| 4,516,697 | A | * | 5/1985 | Dreps et al. ..... 222/212 |
| 5,097,540 | A | | 3/1992 | Lovitt |
| 5,377,364 | A | | 1/1995 | Cabrera |
| 5,409,167 | A | | 4/1995 | Borod |
| 5,858,010 | A | | 1/1999 | Berry |
| 5,864,895 | A | | 2/1999 | Ota et al. |
| 6,145,154 | A | | 11/2000 | Blair |
| 6,190,366 | B1 | | 2/2001 | Tani |
| 6,269,516 | B1 | | 8/2001 | Saatjian et al. |
| 6,272,716 | B1 | | 8/2001 | Thornton |

FOREIGN PATENT DOCUMENTS

| | | |
|---|---|---|
| JP | 9238865 | 9/1977 |
| JP | 9028611 | 2/1997 |
| JP | 9140619 | 6/1997 |
| JP | 10165328 | 6/1998 |
| JP | 11070057 | 3/1999 |
| JP | 11164791 | 6/1999 |

* cited by examiner

*Primary Examiner*—Kevin C. Simmons
(74) *Attorney, Agent, or Firm*—Welsh & Flaxinan LLC

(57) ABSTRACT

The present invention relates to a hand-held device that enables persons of limited mobility to clean their perineal areas, and comprises a liquid reservoir that can be squeezed with gentle pressure, a spraying portion that generates a directed stream of liquid droplets towards the patient, and a tissue holder portion through which the user can grab, use and dispose of cleaning tissue.

15 Claims, 11 Drawing Sheets

SECTION G-G

SECTION E-E

DETAIL H

DETAIL K

DISPOSABLE PERINEUM CLEANING DEVICE

BACKGROUND OF THE INVENTION

1. Field of the Invention

The present invention relates to a device that enables persons of limited mobility to wash and wipe their perineal areas, in order to meet basic needs of hygiene and comfort, and to avoid medical complications such as skin rashes and infections. Examples of persons with limited mobility include arthritic patients, who may experience difficulties in reaching or squeezing with their hands, or in performing wiping motions; bed-confined patients, for whom reaching or cleaning their perineal areas may be difficult because of surgeries, accidents, or other medical conditions; mutilated patients; and overweight persons, whose physical sizes may make it difficult or impossible to reach and clean their genital and anal areas. These users need a device that can be employed safely and conveniently, without concerns about contacts with unsanitary areas or about uncontrolled flow of cleaning liquid during use.

Care providers also need a device that will make patients of limited mobility as self-supporting as possible, that can be easily stored and assembled at the time of use, that can be employed effectively and as contact-free as possible, and that does not require costly and time-consuming sterilization procedures. With the graying of our population, the need for auxiliary cleaning devices is expected to increase significantly over time.

The present invention achieves cleaning of the perineum through a directed stream of liquid droplets that is sprayed through calibrated nozzle holes. The perineal area is successively wiped with a paper or fabric tissue that is gripped, securely held, and eventually released by a tissue holder, which is part of this cleaning device.

2. Description of the Related Art

Cleaning of the perineum not only satisfies a basic desire for hygiene and for comfort, but also meets a basic health requirement by preventing adverse skin reactions and the spreading of infections. Different devices are available today that provide either a stream of cleaning liquid to the perineum, or that, alternatively, hold and extend the reach of cleaning tissue, but no device achieves both functions simultaneously and effectively.

In addition, existing devices are generally larger than the present invention, exhibit more complex mechanical features, and are designed to be reusable, requiring repeated sterilizations. Moreover, such devices usually require the exertion of pressure (for instance, to push a start button) beyond the level of comfort, or even beyond the physical capability, of certain users, such as users with arthritic joints.

U.S. Pat. No. 5,097,540, issued to Lovitt on May 24, 1992, discloses a re-usable hand-held bidet with a spray function, activated by a pump, either mechanical or electric, and without a hygienic tissue holder.

U.S. Pat. No. 5,377,364, issued to Cabrera on Jan. 3, 1995, discloses a portable toilet assembly that includes a bidet-like washing device. Such device is mounted on the portable toilet assembly and is not hand-held nor disposable.

U.S. Pat. No. 5,409,167, issued to Borod on Apr. 25, 1995, discloses a re-usable hygienic spray bottle that dispenses liquid through a L-shaped spray tube and that is pressurized by a pump.

U.S. Pat. No. 5,858,010, issued to Berry on Jan. 12, 1999, discloses a personal washing device for douching the female pelvic or genital areas. Such device exhibits two different configurations of the washing head, but neither appears suitably configured for the anal area nor for male patients, and does not include a tissue holder.

U.S. Pat. No. 5,864,895, issued to Ota on Feb. 2, 1999, discloses a hand-held body washer with a retractable nozzle. This device includes a pump which is housed in a separate container and which is attached to the liquid reservoir, is re-usable, and does not include a cleaning tissue holder.

U.S. Pat. No. 6,145,154, issued to Blair on Nov. 14, 2000, discloses a hygienic tissue or fabric holder for reaching and wiping body parts. Such device is reusable and involves a complex design, requiring a level of dexterity that may be uncomfortable or impossible for arthritic patients.

U.S. Pat. No. 6,190,366, issued to Tani on Feb. 20, 2001, discloses a disposable liquid container made of plastic film, which is connected to a tube and a spray nozzle. A liquid stream is generated by squeezing the liquid container with a movement that may be difficult or impossible for arthritic or bed-confined patients.

U.S. Pat. No. 6,269,516, issued to Saatjian on Aug. 7, 2001, discloses a device for removing human waste that is essentially a remotely-activated spoon with a cover.

U.S. Pat. No. 6,272,716, issued to Thornton on Aug. 14, 2001, disclosed a re-usable device for wiping body parts, activated by pushing a button that opens a pair of longitudinal jaws and that grips the cleaning tissue.

Other prior art discloses mechanical devices that prevent leakage or backflow in hygienic spray bottles.

Japanese Patent 09-028611, issued to Shibagaki Kazuyuki on Jul. 13, 1995, discloses a valve that controls the flow of liquid from a spray bottle to the discharge tube.

Japanese Patent 09-238865, issued by Chugenji Hiroshi on Sep. 16, 1997, discloses a hygienic cleaning bottle with a retractable nozzle, out of which water leakage is prevented during transport by sealing the bottle cap with the nozzle tip, when pushed in the retracted position.

BRIEF SUMMARY OF THE INVENTION

The present invention consists of a device through which fecal or other bodily matter is removed by spraying the perineum with a calibrated stream of cleaning liquid, such as warm water or a medicated solution, which is generated by squeezing a container with gentle pressure. The perineum is then wiped with a paper or fabric tissue that is gripped, securely held and eventually released through a tissue holder which is also part of the device.

The present invention comprises a liquid reservoir; a reservoir cap that closes and seals the liquid reservoir, and to which a discharge tube is attached; a nozzle that is attached to the discharge tube; and a tissue holder that is securely fastened to the liquid reservoir, and that comprises a stem and a clamp to grip, hold and release a cleaning tissue.

The spray nozzle is designed to generate a liquid stream which becomes a flow of liquid droplets that travels through the air in a basically straight line. This provides the user with the comfort of a mist but also with the effectiveness of a directed stream that facilitating removal of fecal or other deposits, and at the same time reducing wetting of patient clothing or bed which is common with continuous liquid streams.

When the reservoir is filled but not in use, and is laid on one side or held with the discharge tube pointing downwards, gravity-related liquid outflows from the nozzle are prevented by nozzle holes of a diameter small enough to generate a combination of surface tension and liquid pressure at the nozzle holes that is less than ambient air pressure. That prevents an undesired dripping of cleaning liquid.

If the reservoir is accidentally squeezed while the tissue holder is used for wiping, the accidental liquid spray is directed away from the user because the nozzle holes are designed to point in a direction opposite to that of the tissue clamp. In one embodiment, the risk of accidental spraying is further reduced by positioning the discharge hole on the reservoir cap off the center of the cap, in a position opposite to where the liquid would tend to flow due to gravity when the reservoir is tilted during wiping.

The present invention is intended for a limited number of uses and is disposable. The materials employed allow for sanitary disposal through incineration; in particular, the device can be shipped, used and incinerated together with a disposable bedpan. During storage and before use, the device can rest on the cylindrical base of the liquid reservoir opposite to the filling cap, with the tissue holder disassembled and locked into a semi-circular ring built into the reservoir cap.

BRIEF DESCRIPTION OF THE SEVERAL VIEWS OF THE DRAWING

The accompanying drawings provide a further understanding of the invention and are incorporated in, and constitute part of, this specification.

DETAILED DESCRIPTION OF THE INVENTION

A detailed description of the invention follows, which is merely representative, because the various components may be embodied in a variety of forms. The details described here are deemed to represent the best embodiment for the purpose of disclosure, and to provide a basis for the claims which define the scope of the present invention. The invention, however, is capable of other embodiments, and the phraseology and terminology employed here are only for the purpose of description, and should not be regarded as limiting.

Figure 1:
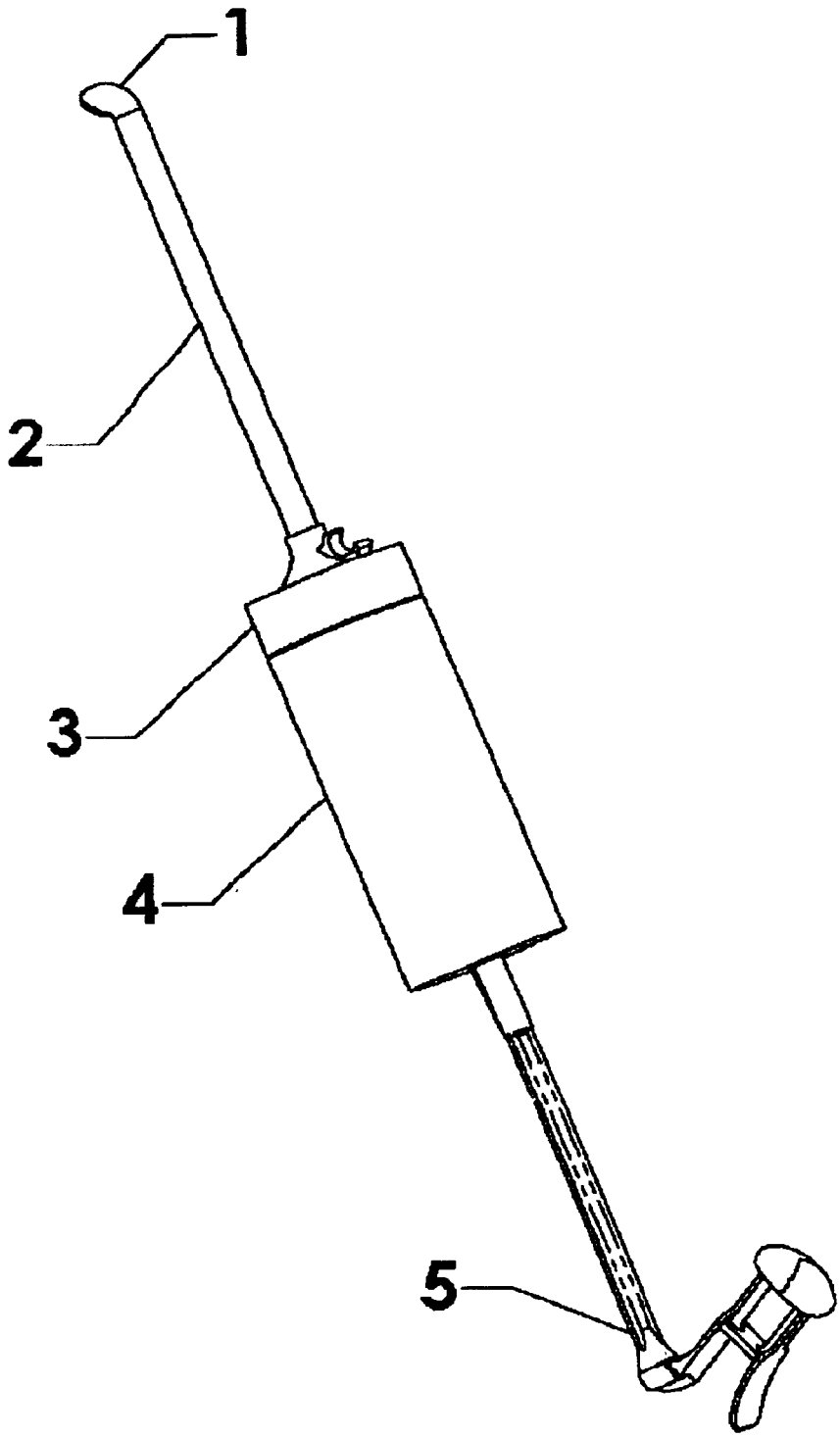
FIG. 1 illustrates the disposable perineum cleaning device in accordance to a first embodiment of the invention.
Figure 4:
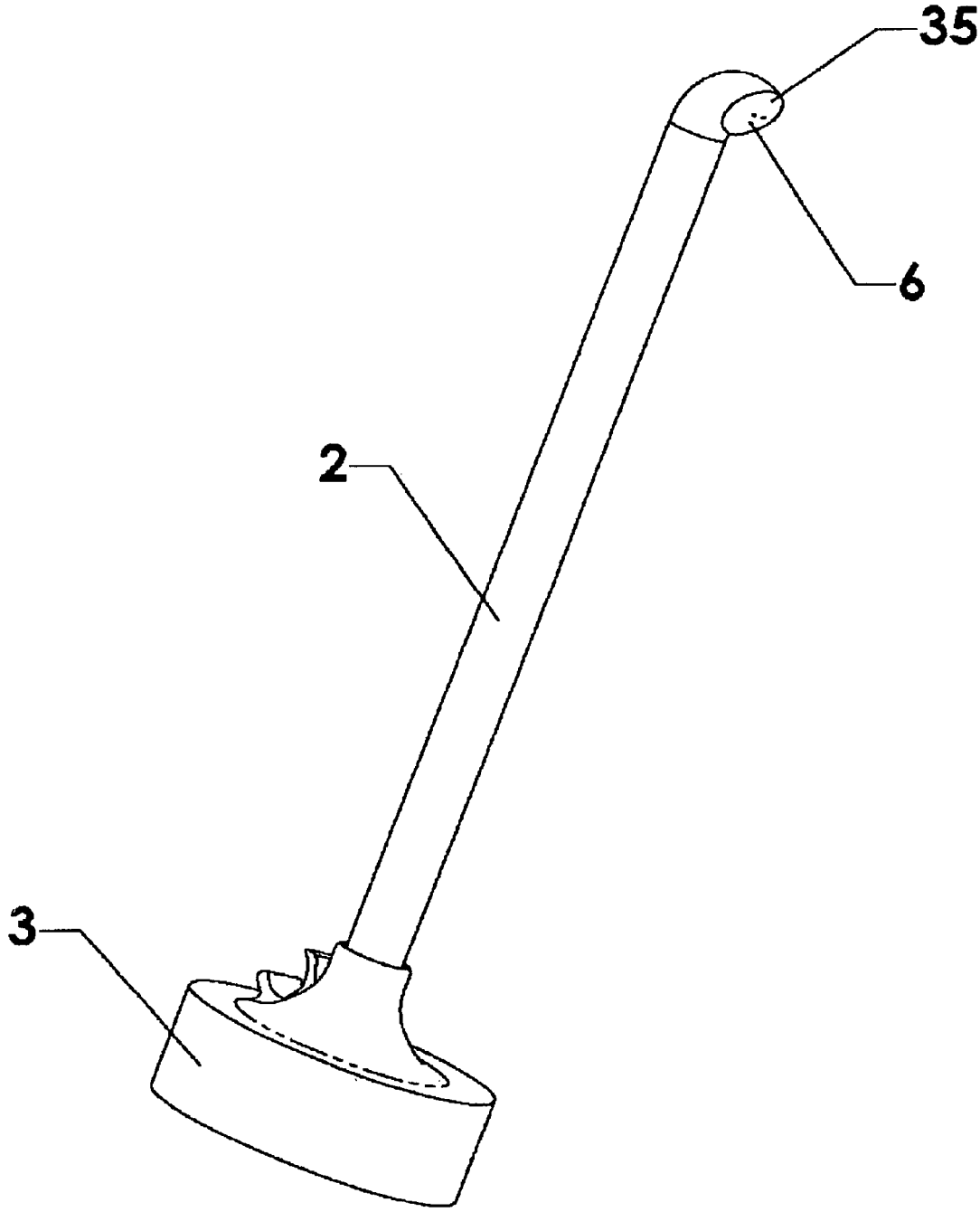
FIG. 4 illustrates the combination of reservoir cap, discharge tube and spray nozzle in accordance to a first embodiment of the invention.

Referring to FIGS. 1 and 4, the disposable perineum cleaning device is shown in a first embodiment, which comprises reservoir 4, reservoir cap 3, discharge tube 2, nozzle 1, and tissue holder 5. Typically, the device is supplied to the user in three disassembled pieces, namely, reservoir 4; tissue holder 5; and the pre-assembled combination of reservoir cap 3, discharge tube 2, and nozzle 1.

In the preferred embodiment, reservoir 4 is made of polypropylene. Other resilient materials may be employed that retain their shape regardless of whether the reservoir is empty or full, but that can also be squeezed with gentle pressure returning to their original shape after squeezing pressure is released.

Figure 2:
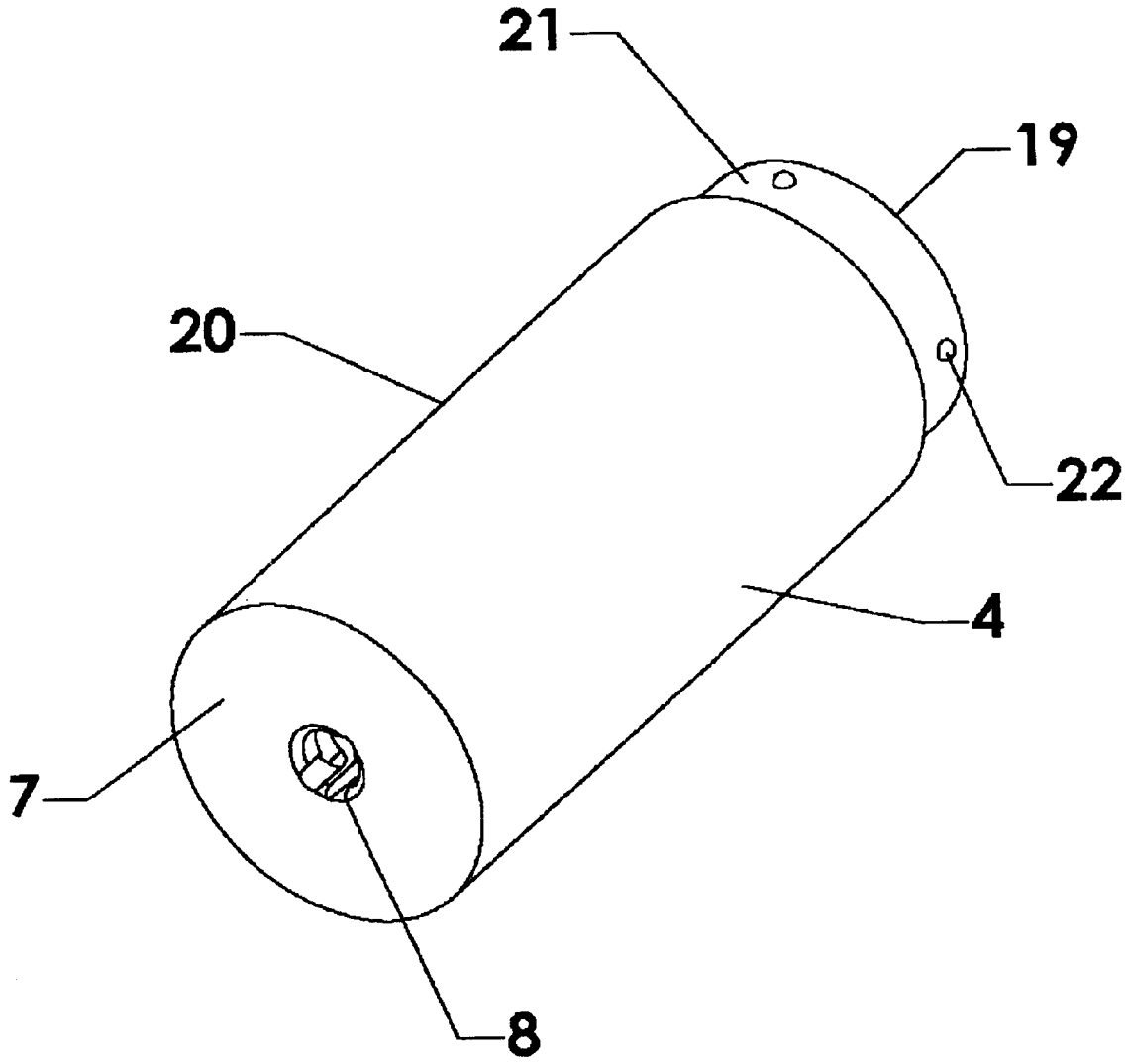
FIG. 2 illustrates the liquid reservoir in accordance to a first embodiment of the invention.

Referring to FIGS. 2 and 4, reservoir 4 has a cylindrical configuration, of a diameter that can be comfortably held in a human hand. The volume of reservoir 4 is such that, when reservoir 4 is not squeezed and is combined with discharge tube 2 and nozzle 1, the combination of surface tension and maximum liquid pressure at holes 6 of nozzle 1 withstands one bar atmospheric pressure. In the preferred embodiment, reservoir 4 has a circular cross-section of 2" diameter, 4.5" height, and 0.060" wall thickness, and nozzle holes 6 have a 0.020" diameter.

Other embodiment have different reservoir and nozzle holes dimensions, but achieve the same design objectives of fitting within a human hand and of avoiding undesired liquid outflow while not in use.

Reservoir 4 exhibits an external surface that is smooth. In other embodiments, the external surface is corrugated for better grip, or carries ergonomic impressions for lodging a human hand comfortably.

Figure 3:
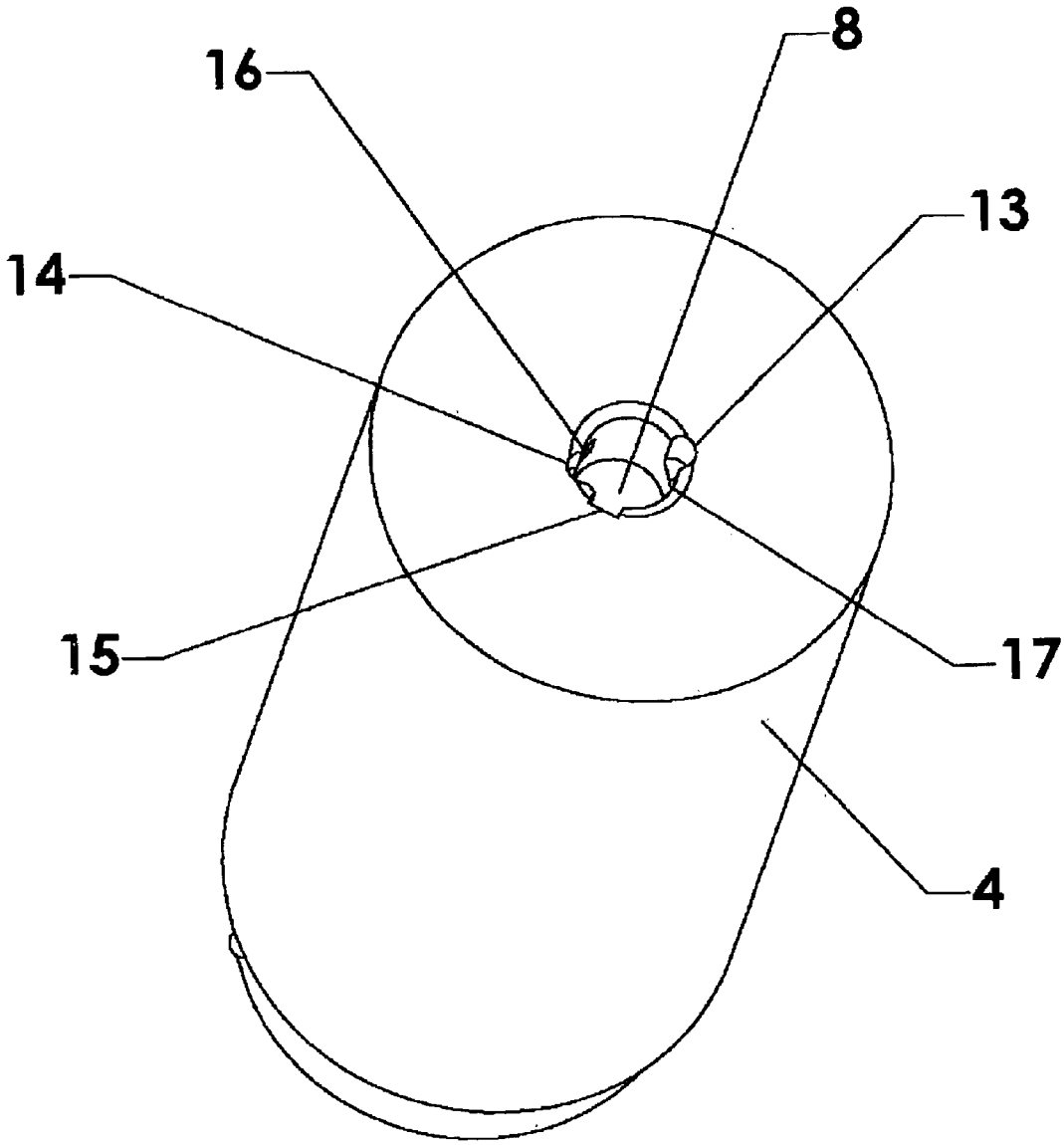
FIG. 3 illustrates the depression on the closed end of the liquid reservoir.
Figure 6:
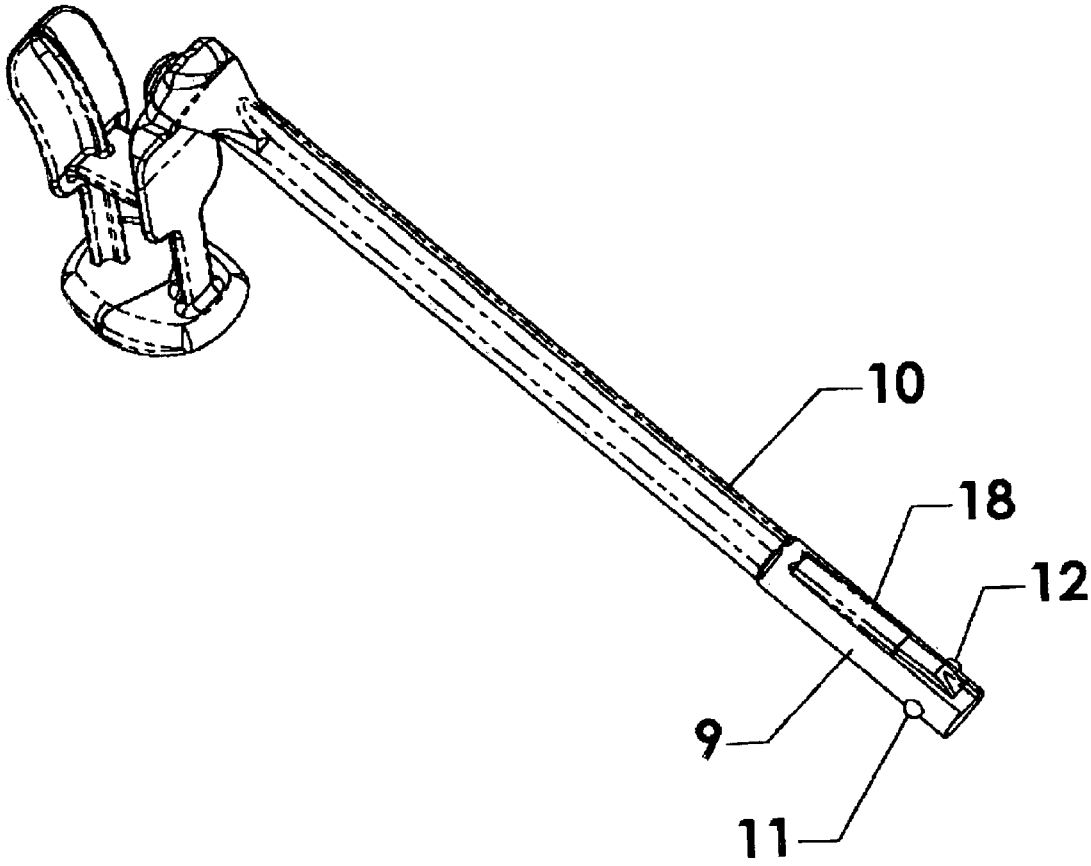
FIG. 6 illustrates the base of the stem portion of the tissue holder, including protruding pins and spring clip.
Figure 7:
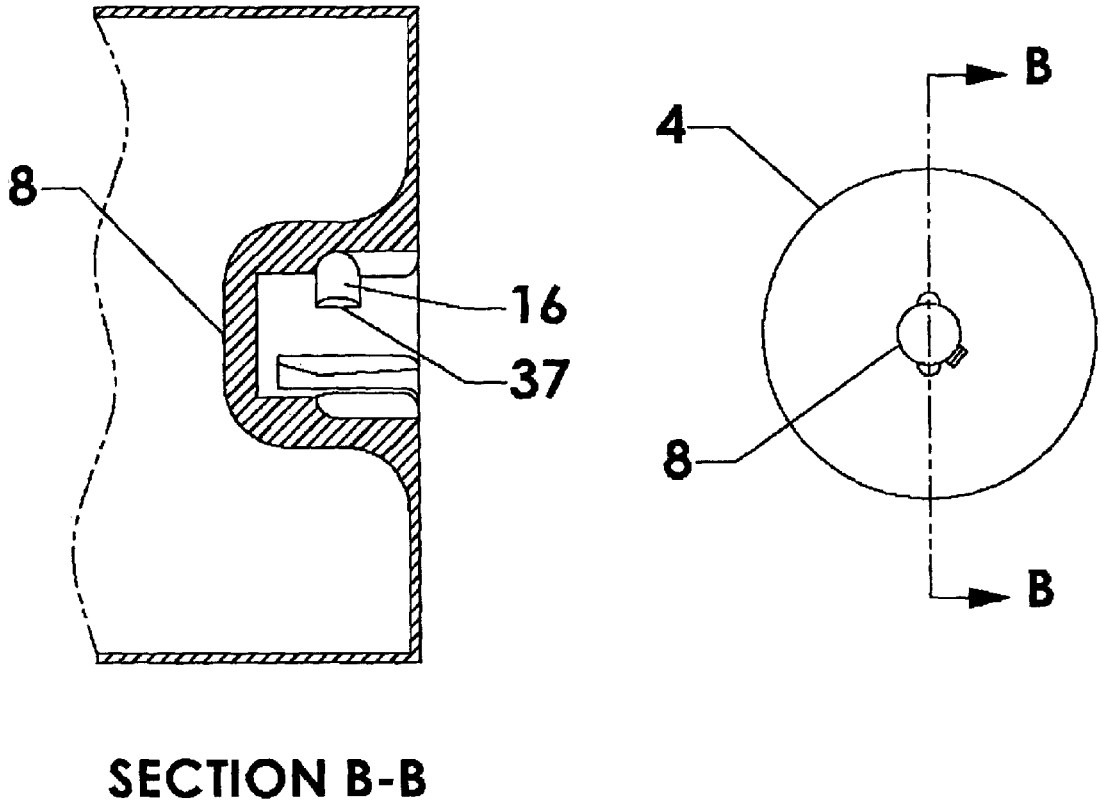
FIG. 7 illustrates a cross-section of the depression on the closed end of the liquid reservoir, including a groove with detents and the recess for the spring clip.

Referring further to FIGS. 3, 6 and 7, end 7 of reservoir 4 is closed, and carries a depression 8 of a roughly circular shape, that is the housing for base 9 of stem 10 of tissue holder 5. Base 9 is slid and securely locked in depression 8 at the time tissue holder 5 is used. Depression 8 has two keyways 13, 14 and recessb 15 extending from its roughly circular shape. Two pins 11 and 12 protruding from base 9 of stem 10 slide into keyways 13 and 14 and further slide into grooves 16 and 17 that are located on the inner wall of depression 8. Pairs of detents 37 extending from grooves 16 and 17 lock pins 11 and 12 in place when tissue holder 5 is turned clockwise. Recess 15 further locks base 9 in place after stem 10 is turned, due to spring clip 18 that is also located on base 9 and that compresses against base 9 when inserted into depression 8. Spring clip 18 then springs back into its released position when, after being turned into position, it meets matching keyway 15.

Figure 8:
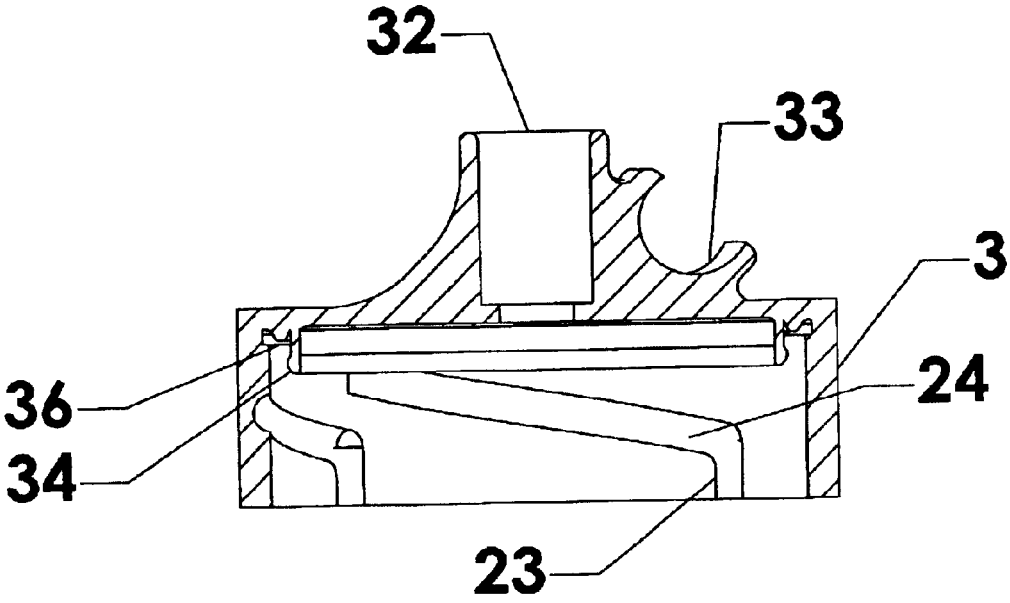
FIG. 8 illustrates a cross-section of the reservoir cap in accordance to a first embodiment of the invention, including grooves, keyways and the semicircular extension which holds the stem portion of the tissue holder.
Figure 8:
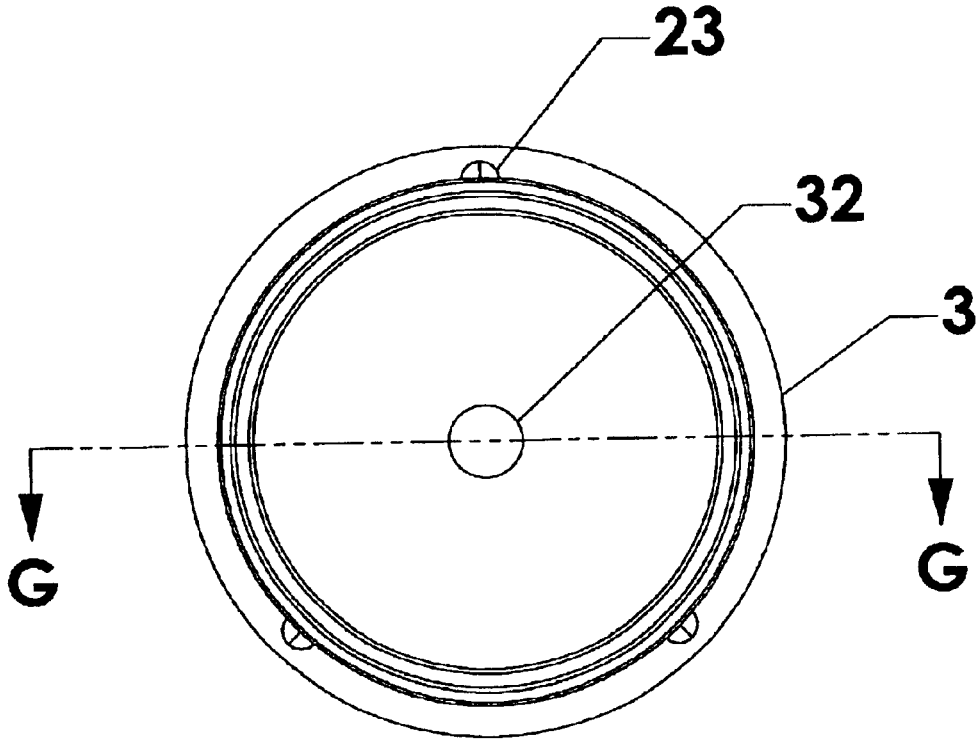

Further referring to FIGS. 2 and 8, circular end 19 of reservoir 4 is open, and is designed to be closed and sealed through reservoir cap 3. Wall 20 of reservoir 4, in the proximity of end 19, has a recessed surface 21 with three protruding pins 22, which are designed to match and slide into three keyways 23 on reservoir cap 3, leading to three spiral grooves 24 on the inner wall of reservoir cap 3.

Both grooves 16 and 17 inside depression 8 of reservoir 4, and grooves 24 on the inner wall of reservoir cap 3, are designed so to orient spray nozzle 1 and clamp 25 of tissue holder 5 in directions opposite to each other, in order to have the liquid spray away from the patient, if the patient inadvertently squeezes reservoir 4 while using tissue holder 5.

It is to be understood that the reservoir in the present invention is not restricted to the above described modes, and that modifications and variations of the reservoir that do not depart from the spirit and scope of the present invention are encompassed within this invention.

Figure 5:
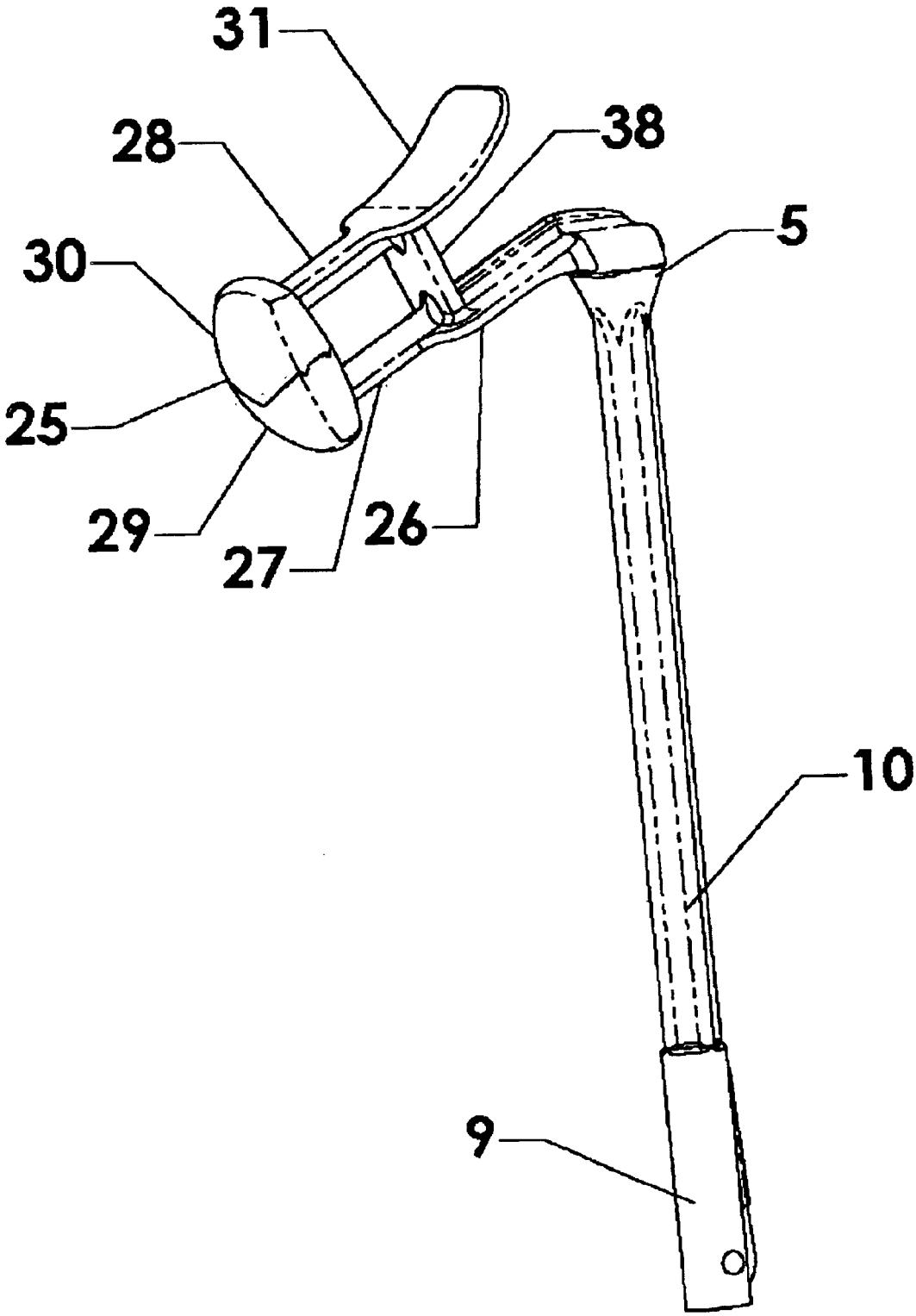
FIG. 5 illustrates the tissue holder, including the stem portion, the clamp portion and the connecting structure.

Further referring to FIG. 5, tissue holder 5 comprises two main portions, stem 10 and clamp 25, which are linked by connecting structure 26. In the preferred embodiment, tissue holder 5 consists of a single, integrally molded piece made of a high performance synthetic material such as polypropylene, acetal, nylon or ABS.

Figure 9:
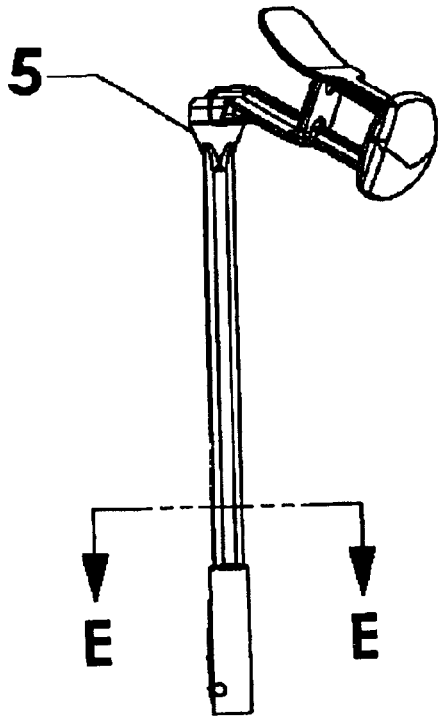
FIG. 9 illustrates a cross-section of the stem portion of the tissue holder in accordance to a first embodiment of the invention.
Figure 9:
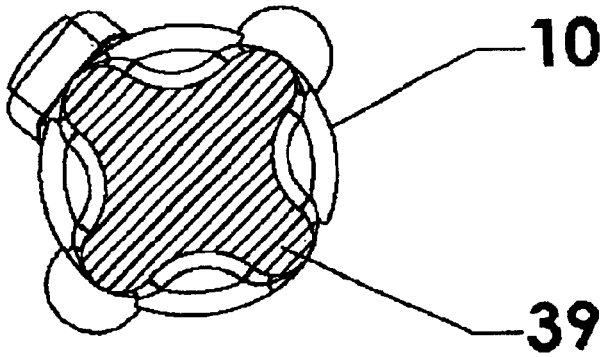

As shown in FIG. 9, in the preferred embodiment, stem 10 of tissue holder 5 has a solid, X-shaped cross-section 39 along its length and with a solid cylindrical section at base 9. Other embodiments include a profile of stem 10 with a tubular profile, or with different cross-section profiles. Stem 10 in the preferred embodiment has a straight shape. Other embodiments include different lengths and shapes of stem 10, such as hook-shaped, J-shaped, or arched.

Stem 10 of tissue holder 5 is joined to tissue clamp 25 via connecting structure 26 that comprises parallel arms 27 and 28 joined by perpendicular flexing wall 38. Arm 28 connects upper half 30 of clamp 25 to lever 31, which causes flexing wall 38 to bend when lever 31 is depressed, and clamp 25 to open, and which further causes flexing wall 38 to return to its straight position, and clamp 25 to close, when lever 31 is released. Lever 31 is ergonomically designed to fit the fore part of a human thumb and requires a pressure low enough to be comfortable for arthritic users. Lower arm 27 of connecting structure 26 joins stem 10 to lower half 29 of tissue clamp 25. In the preferred embodiment, connecting structure 26 is integrally molded with stem 10 and clamp 25.

Figure 10:
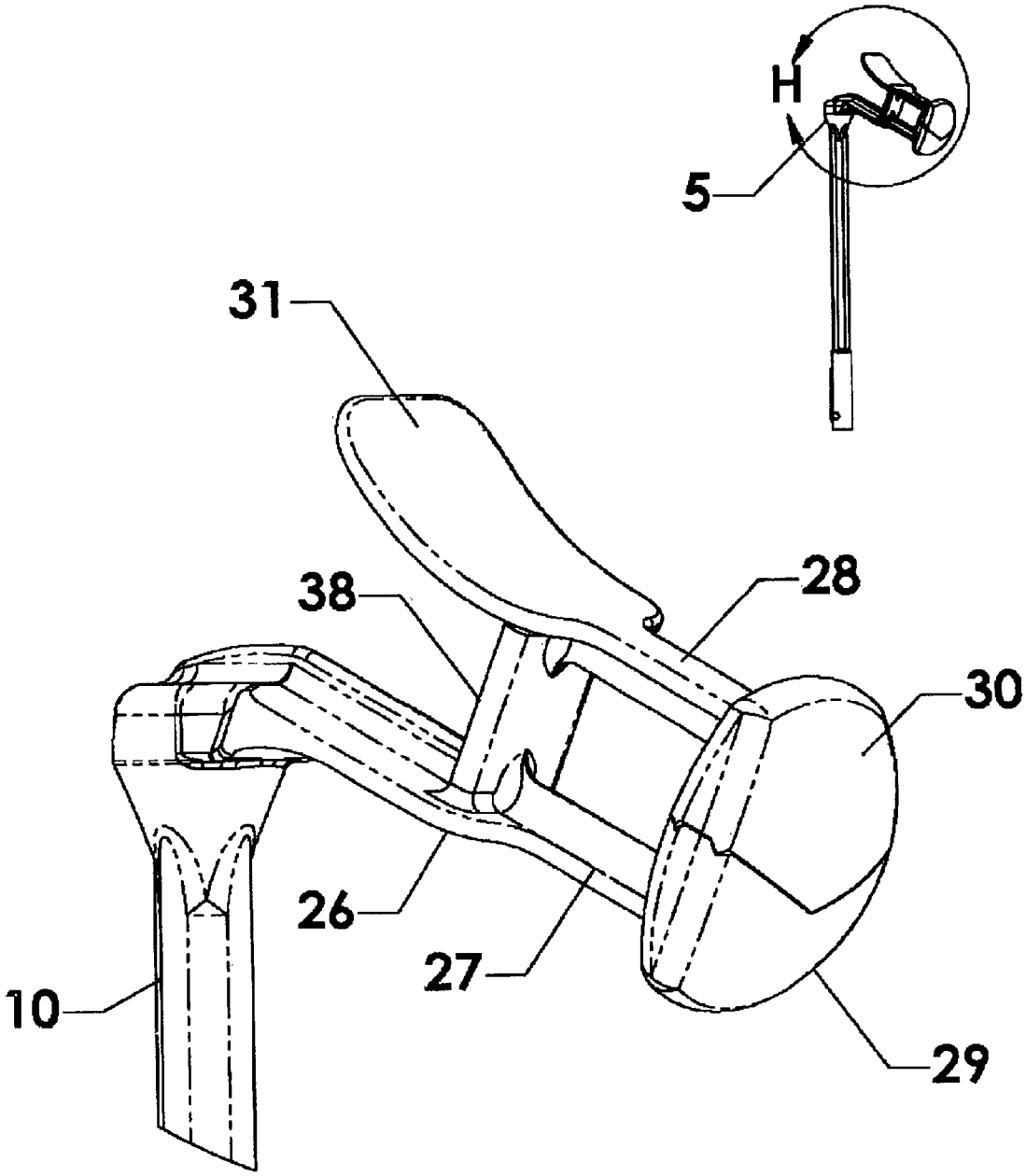
FIG. 10 illustrates the clamp portion of the tissues holder, including the upper and lower halves of the clamp, the connecting structure to the stem portion, and the lever opening said clamp portion.
Figure 11:
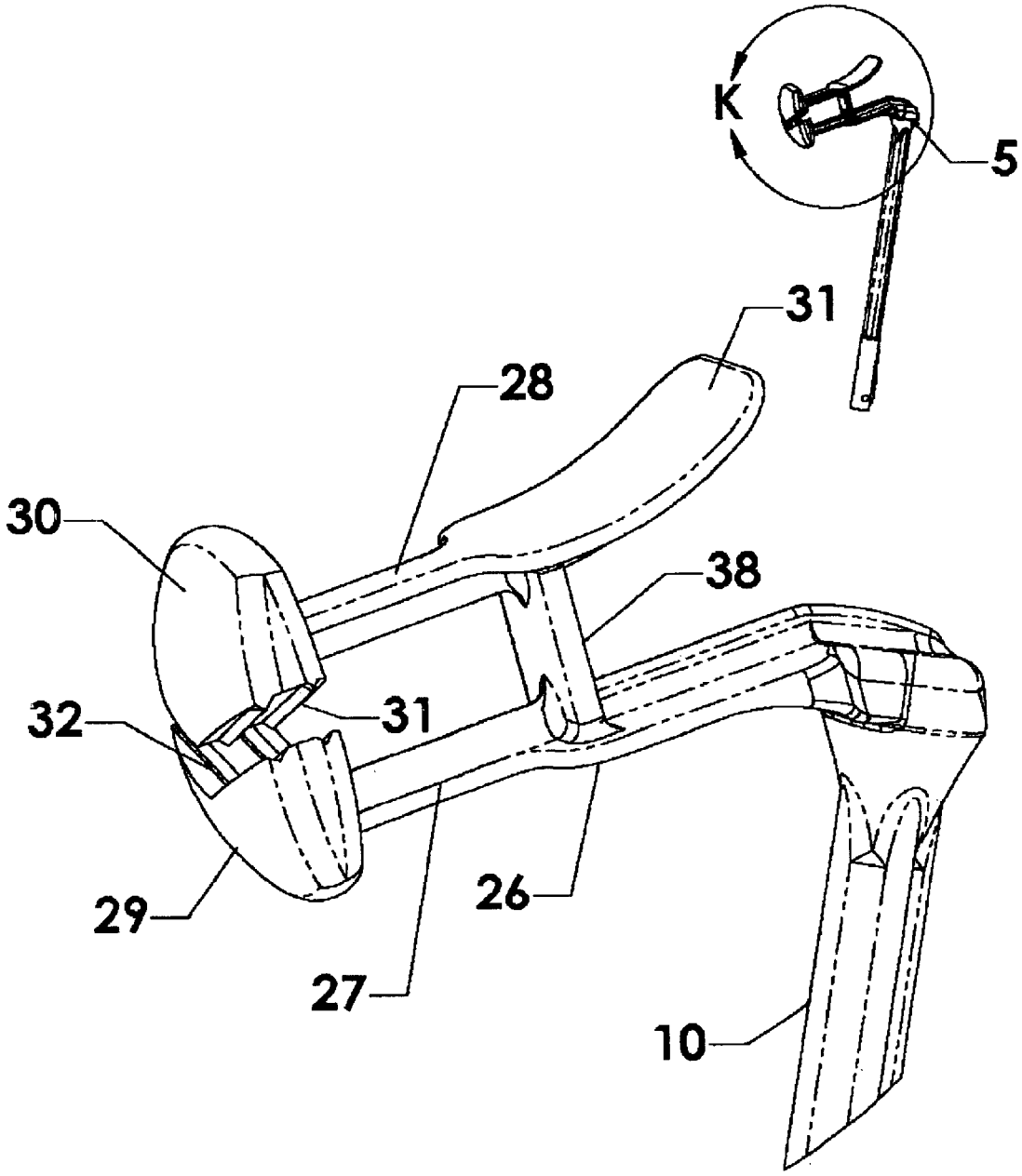
FIG. 11 illustrates a second embodiment of the clamp portion of the tissue holder, which includes protruding teeth along the arrow-shaped profile of the upper half of the clamp portion and matching tooth-shaped depressions along the V-shaped profile of the lower half of the clamp portion.

With further reference to FIG. 10, upper half 30 of clamp 25 has an arrow-shaped contour matching lower half 29, which instead exhibits a V-shaped contour. This arrow-and-V design makes clamp 25 extremely effective in gripping and securely holding the cleaning tissue. With reference to FIG. 11, in one embodiment, two parallel, tooth-shaped protrusions 31 run along the arrow-shaped contour of upper half 30, while the V-shaped contour of lower half 29 contains matching tooth-shaped depressions 32, so to increase grip on the cleaning tissue when clamp 25 is closed.

The front part of clamp 25 exhibits an outer surface that is rounded and smooth, in order to increase comfort to the user and to prevent adhesion of fecal matter. Size and movement of clamp halves 29 and 30 resemble human fingers, both in the gripping and in the wiping motions. In the preferred embodiment, ergonomics of the tissue holder is enhanced through a 65 degrees angle between the clamp and the stem.

Reservoir cap 3 is removable and locks securely onto reservoir 4. With further reference to FIG. 8, in the preferred embodiment, reservoir cap 3 has a round opening 32 in the center, in which discharge tube 2 is press-fit. In a different embodiment, opening 32 is positioned off-center, on the same side of the longitudinal axis of the device as tissue clamp 25, in order to improve flow of liquid to discharge tube 2 when reservoir 4 is held at an angle with discharge tube 2 pointing downwards, and, during wiping, to decrease flow of liquid to discharge tube 2 and to minimize risk of undesired spraying if reservoir 4 is inadvertently squeezed.

Three keyways 23 leading to three spiral grooves 24 are located on the inner cylindrical wall of reservoir cap 3, and match pins 22 on recessed area 21 of reservoir 3. A protruding wall 34 creates a depression 36 on the inner surface of reservoir cap 3 and generates a tight seal between the recessed area 21 of reservoir 4 and reservoir cap 3.

A semi-circular extension 33 is integrally molded into the external side of reservoir cap 3, and is designed to house and lock in place stem 10 of tissue holder 5, when tissue holder 5 is not attached to depression 8 of reservoir 4. In the preferred embodiment, reservoir cap 3 is manufactured from polypropylene. In other embodiments, other types of plastic such as polyethylene and nylon can be employed.

Discharge tube 2 is essentially rigid, achieving a limited degree of bending when pressed against the perineal surface, in order to facilitate spraying of hard-to-reach body parts. Discharge tube 2 is also resilient, returning to its original shape after a slight bending. In the preferred embodiment, discharge tube 2 is made from polypropylene, but can be made from other plastic materials such as polyethylene or nylon. The shape of discharge tube 2 is straight in the preferred embodiment, without internal reinforcing walls. Other embodiments include discharge tubes 2 that are hook-shaped, J-shaped or curved.

Nozzle 1 is located at the free end of discharge tube 2, and generates a liquid spray that turns into a directed stream of liquid droplets during travel in the air. Three parallel nozzle holes 6, perpendicular to nozzle face 35 and spaced 0.086" apart, are positioned in a triangular pattern on the face of nozzle 1 and produce a liquid stream that maintains an essentially triangular configuration during travel in the air. While traveling, due to the combination of hole diameter, air friction and surface tension, the liquid stream becomes a stream of liquid droplets that produces the comfort of a mist and reduces the wetting of linens that is common with directed liquid streams. In another embodiment, nozzle holes 6 are not parallel but directed outwards at an angle from nozzle face 35, for instance, an 85 degree angle.

In the preferred embodiment, nozzle 1 is J-shaped, with face 35 angled at 35 degrees from stem 10. This generates a liquid stream at 55 degrees from stem 10 for optimal user ergonomics. The external surface and edges of nozzle 1 are curved and smooth, in order to minimize friction with the body of the user and to reduce adhesion of fecal matter.

In the preferred embodiment, nozzle 1 is made of polypropylene, but can be manufactured from other synthetic materials such as polyethylene, nylon or ABS.

What is claimed is:

1. A disposable perineum cleaning device, consisting of:

a liquid reservoir of a resilient synthetic material having an open top thereof, and a depression on a bottom thereof;

a combination including a reservoir cap, a discharge tube, and a spray nozzle, said combination being releasably mounted on said open top through locking means, with cleaning liquid being forced, upon pressing said liquid reservoir, from said liquid reservoir through an opening in said reservoir cap into said discharge tube and successively into said spray nozzle; said reservoir cap being releasably attached to said reservoir through locking means and having an opening where the bottom end of said discharge tube is inserted; said discharge tube having one bottom end inserted in said opening of said reservoir cap, and being connected with said spray nozzle at the top end;

a tissue holder comprising a stem portion and a clamp portion;

said stem portion being releasably attached at its base through fastening means to said depression within said liquid reservoir, said stem portion being connected at the opposite end of said stem portion to said clamp portion through a connecting structure;

said connecting structure comprising a lower arm, an upper arm and a flexing wall, said lower arm being attached to said stem portion at one extremity and to the lower half of said clamp portion at the other extremity, said upper arm being connected to the upper half of said clamp portion at one tip and being shaped into a lever at the other tip, said upper arm and said lower arm being parallel to each other and being connected through said flexing wall, which runs perpendicular to said lower arm and said upper arm and which causes said clamp portion to open when said lever is depressed thereby bending said flexing wall, and to close when said lever is released and said flexing wall returns to a straight position;

said clamp portion consisting of two matching halves, with said lower half of said clamp portion being attached to said lower arm of said connecting structure, and said upper half of said clamp portion being attached to said upper arm of said connecting structure.

2. The disposable perineum cleaning device of claim 1 where the liquid reservoir has a circular cross-section.

3. The disposable perineum cleaning device of claim 2 where the liquid reservoir has a 2" diameter and is 4.5" high.

4. The disposable perineum cleaning device of claim 1 where the opening in the reservoir cap is in central position.

5. The disposable perineum cleaning device of claim 1 where the opening in the reservoir cap is in a position off the center of said reservoir cap.

6. The disposable perineum cleaning device of claim 1 where the locking means releasably attaching the reservoir cap to the liquid reservoir consist of a bayonet mount including three pins protruding from the outer wall of said liquid reservoir and three matching spiral grooves on the inner wall of said reservoir cap.

7. The disposable perineum cleaning device of claim 1 where the outer surface of the reservoir cap includes a semi-circular ring that holds the stem portion of the tissue holder when said tissue holder is not in use.

8. The disposable perineum cleaning device of claim 1 where the fastening means, locking the stem portion of the tissue holder to the liquid reservoir, is a bayonet mount including: a spring clip and two protruding pins located on the base of said stem portion, two matching keyways within a depression located on said liquid reservoir that lead to two radial grooves, detents positioned at the end of said grooves, and a recess in said depression where said spring clip comes to rest after and is released.

9. The disposable perineum cleaning device of claim 1, where the nozzle has three parallel holes positioned in a triangular pattern.

10. The nozzle of claim 9, where the nozzle holes have a 0.020" diameter.

11. The nozzle of claim 9, where the nozzle holes are not parallel but directed outwards at an angle from the longitudinal axis of said nozzle.

12. The nozzle of claim 11, where the nozzle holes are directed outwards at a 5 degree angle from the longitudinal axis of said nozzle.

13. The clamp portion of claim 12, where the upper half of said clamp portion exhibits two parallel teeth running along, and protruding from, its triangular profile, and the lower half of said clamp portion exhibits two parallel depressions running along its V-shaped profile and matching said teeth.

14. The disposable perineum cleaning device of claim 1, where the stem portion of the tissue holder is a tubular structure with inner, X-shaped reinforcing walls.

15. The disposable perineum cleaning device of claim 1, where the clamp portion consists of an upper half that is of essentially triangular shape, and of a bottom half that is a V-shaped depression matching said upper half.

* * * * *